United States Patent [19]

Hausmann et al.

[11] Patent Number: 4,609,279

[45] Date of Patent: Sep. 2, 1986

[54] LASER PRINTING SYSTEM WITH A SOLVENT VAPOR FIXING STATION AND ADAPTABLE FOR EITHER MULTICOLOR OR VERSO PRINTING

[75] Inventors: Gerhard Hausmann, Olching; Hübert Mügrauer, Poering; Helmut Naeser, Munich, all of Fed. Rep. of Germany

[73] Assignee: Siemens Aktiengesellschaft, Berlin and Munich, Fed. Rep. of Germany

[21] Appl. No.: 703,915

[22] Filed: Feb. 21, 1985

[30] Foreign Application Priority Data

Feb. 21, 1984 [DE] Fed. Rep. of Germany ..... 3406244

[51] Int. Cl.[4] ..... G03G 15/20

[52] U.S. Cl. ..... 355/3 SH; 355/3 R; 355/3 FU; 355/24

[58] Field of Search ..... 355/3 SH, 3 R, 24, 26, 355/4, 10, 3 FU, 14 FU

[56] References Cited

U.S. PATENT DOCUMENTS

| | | | |
|---|---|---|---|
| 3,548,783 | 12/1970 | Knapp | 355/26 X |
| 3,694,073 | 9/1972 | Bhagat | 355/26 X |
| 3,991,713 | 11/1976 | Whited | 118/653 |
| 4,236,814 | 12/1980 | Tonkin | 355/26 |
| 4,239,370 | 12/1980 | Kurita | 355/4 |
| 4,264,304 | 4/1981 | Hausmann | 432/59 |

FOREIGN PATENT DOCUMENTS

| | | |
|---|---|---|
| 2717260 | 4/1982 | Fed. Rep. of Germany . |
| 3048477 | 10/1982 | Fed. Rep. of Germany . |
| 3324996 | 1/1984 | Fed. Rep. of Germany . |
| 347209 | 8/1960 | Switzerland . |
| 1472357 | 5/1977 | United Kingdom . |

OTHER PUBLICATIONS

Patent Abstracts of Japan, vol. 4, No. 103 (P-20), Jul. 23, 1980.

*Primary Examiner*—A. C. Prescott

*Attorney, Agent, or Firm*—Hill, Van Santen, Steadman & Simpson

[57] ABSTRACT

A laser printing system for multi-color and verso printing is formed of a plurality of units arranged in series which are simultaneously operated. A recording medium emerging from a paper exit region of a preceding unit is supplied to a paper entry region of the following unit. A switchable deflection means for the paper web is disposed in at least one of or between the units. The individual units can thus be constructed of individual fixing modules and printer modules which can be combined with one another. At least one fixing module follows a plurality of printer modules.

21 Claims, 10 Drawing Figures

FIG 6
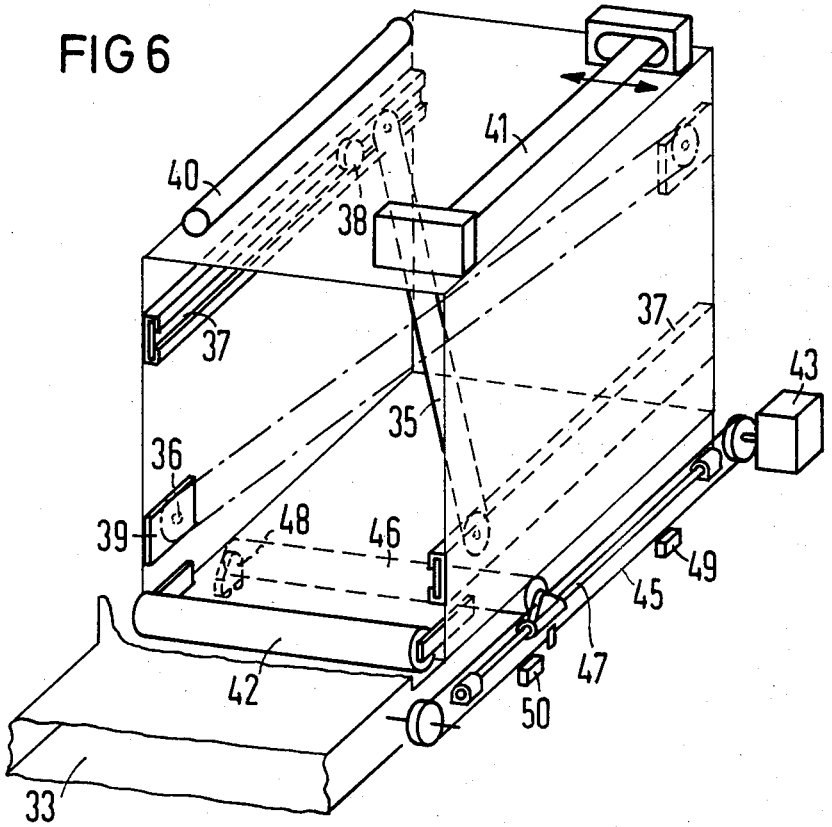
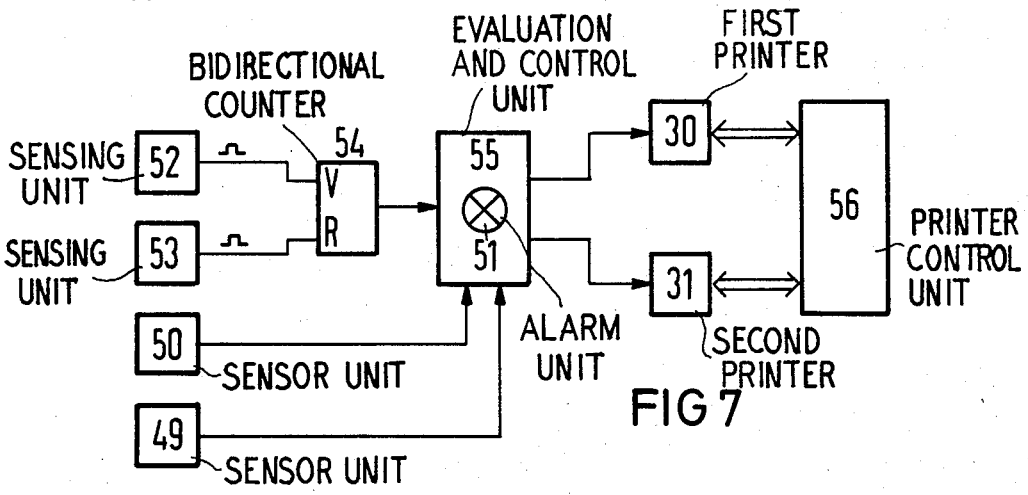
FIG 7

FIG 8
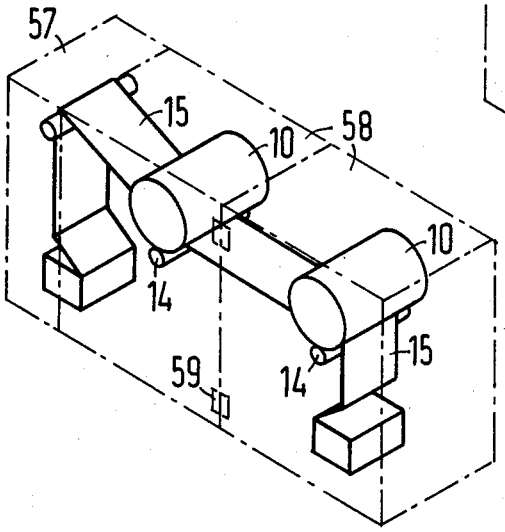
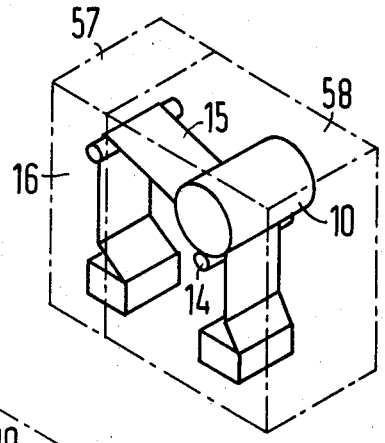
FIG 9
FIG 10
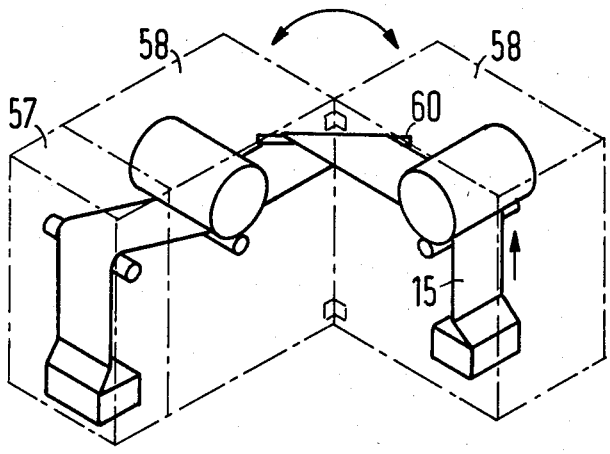

LASER PRINTING SYSTEM WITH A SOLVENT VAPOR FIXING STATION AND ADAPTABLE FOR EITHER MULTICOLOR OR VERSO PRINTING

BACKGROUND OF THE INVENTION

The invention relates to a non-mechanical printer or copier wherein a toner image is developed in a developing stage and applied to a tape-shaped recording medium in a transfer station. A fixing station is also provided for fixing the image Non-mechanical printers such as laser printers, for example, are universally known and have been successfully employed.

With the assistance of a laser or a magnetic recording means, a latent image is generally produced on a photoconductive drum or on a magneto-sensitive drum. This latent image is developed by applying toner in a developing station and then is transferred to a band-like recording carrier in the following transfer station. The image consisting of toner loosely situated on the recording carrier is fixed with the assistance of a melt-fixing means such as is known, for example, from German OS No. 27 17 260, incorporated herein by reference. The band-like recording medium is then deposited via an automatic paper stacker.

In addition to standard hot-melt fixing employed in copiers functioning according to the xerographic principal, it is also known in laser printers such as disclosed in German Letters Pat. No. 30 48 477, corresponding to U.S. Ser. No. 319,727 incorporated herein by reference, to employ fixing stations wherein the fixing of the toner mixture occurs via a fixing agent vapor.

Given the high printing output of laser printers on the order of about 100 pages per minute and above, the paper consumption plays a large part. For this reason, numerous attempts have been undertaken to design the laser printer such that the verso or backside of the paper web can also be printed.

This, however, involves great difficulties since an ironing effect which prevents repeated printing, for example, for verso printing, occurs in the printer due to the known hot-melt fixing.

A further problem in laser printers is multi-color printing. It is in fact known from U.S. Pat. No. 3,991,713, incorporated herein by reference, to dispose a plurality of developing stations having toner of different colors at the circumference of the photoconductive drum. This is true for copiers in general. The transfer of this teaching to a laser printer, however, fails due to the high printing speed resulting in a mixing of the individual toners with one another. The frequently required cleaning of the individual developing stations would constantly interrupt the printer operation.

The same reservations also apply to non-mechanical printers or copiers wherein a magneto-sensitive drum on which the latent image is generated by magnetization is employed instead of the photoconductive drum.

SUMMARY OF THE INVENTION

An object of the invention is to design a non-mechanical printer or copier of the type initially cited in such fashion that it is suitable both for verso printing as well as for multicolor printing.

Given an apparatus of the type initially cited, this object is achieved by providing first and second printer or copier units and wherein at least one of the first and second units has a fixing station means associated therewith for fixing the image. The first and second units each have a developing station and a transfer station. The first and second units are connected in series and simultaneously operated. Means are provided such that the recording medium emerging from the medium exit region of a preceding first unit is supplied to a medium entry region of the succeeding second unit.

In non-mechanical printers or copiers where the fixing station functions according to the principal of cold fixing, then a plurality of units can be disposed in series and can be simultaneously operated. As a result of this simultaneous operation, both multi-color printing as well as verso printing can be carried out.

The verso printing is significantly facilitated when a turning means which, for example, can be composed of a simple deflection element, is disposed between two units in the paper guidance channel.

When the individual units are composed of mutually coupleable fixing modules and printer modules, then a particularly advantageous and simple structure of the overall printing system results. Thus, for example, two printer modules can be pivotably connected with the assistance of a simple hinge. Changing between multi-color printing and verso printing thus becomes particularly simple. The print system can be converted from multi-color printing to verso printing by simply pivoting the printer modules apart and inserting a deflection rod which, for example, can already be integrated in the printer module. A plurality of printer modules thus comprise a fixing station disposed at the end of the printing system.

Given an advantageous embodiment of the invention, the deflection means disposed between two apparatus or two printer modules is composed of a simple oblique deflection element fashioned from a rod which is designed to be pluggable within the paper entry region of the printer or apparatus accepting the paper web. It is pluggable from a position turning the paper web into a position deflecting the paper web. The apparatus can thus be simply re-equipped for a great variety of functions and can be employed as a discrete apparatus when the rod is removed.

In order to achieve a particularly simple and reliable handling, the paper web is guided between the discrete units in a crush-proof tunnel.

In the paper entry region of the apparatus accepting the paper web, this tunnel comprises a paper length compensating means designed as a loop puller. This paper length compensation means is composed of a stationarily disposed deflection roller and of a second motor-driven deflection roller longitudinally displaceable between an idle position and a paper insertion position. For inserting the paper, the motor-displaceable deflection roller is moved out of the paper entry region of the unit accepting the paper web in a simple fashion.

During the print mode given inserted paper, the motor constantly generates a restoring force acting on the second deflection roller with which the paper is tensioned.

Sensing contacts disposed in the range of displacement of the second deflection roller are in communication with an alarm means or control means. When the length of paper becomes too short, for example as a consequence of an asynchronous running of the two apparatus, then the second deflection roller is pressed against the front sensing contact as a consequence of the paper length arrangement, and the contact is thus triggered.

Given too great a paper length between the printer modules or apparatus, the back contact is triggered, again via the second deflection roller.

Two simultaneously operated printer modules or units can be synchronized in a simple fashion since, in accordance with an advantageous embodiment of the invention, timing discs with sensing means are provided in the region of the paper transport devices of the individual unit, said timing discs sensing the paper feed and generating discrete pulses therefrom. The signals output from the sensing means are thus supplied in common to a bidirectional counter which is in turn in communication with an evaluation means designed as a simple comparison means. The counter reading of the bidirectional counting means is a measure for the synchronous running of the units, whereby one of the two units is stopped via the evaluation means when the units drift apart beyond a tolerable degree.

BRIEF DESCRIPTION OF THE DRAWINGS

FIG. 6 is a schematic partial illustration of the deflection means employed in the laser printing system with a corresponding paper length compensation means;

FIG. 7 is a schematic block diagram of a synchronizing means for the paper feed;

FIG. 8 is a schematic illustration of a discrete unit composed of a fixing module and a printer module;

FIG. 9 is a schematic illustration of a laser printing system for one-sided color printing composed of fixing modules and printer modules; and FIG. 10 is a schematic illustration of a laser printing system for verso printing composed of a fixing module and a printer module.

DESCRIPTION OF THE PREFERRED EMBODIMENTS

Figure 1:
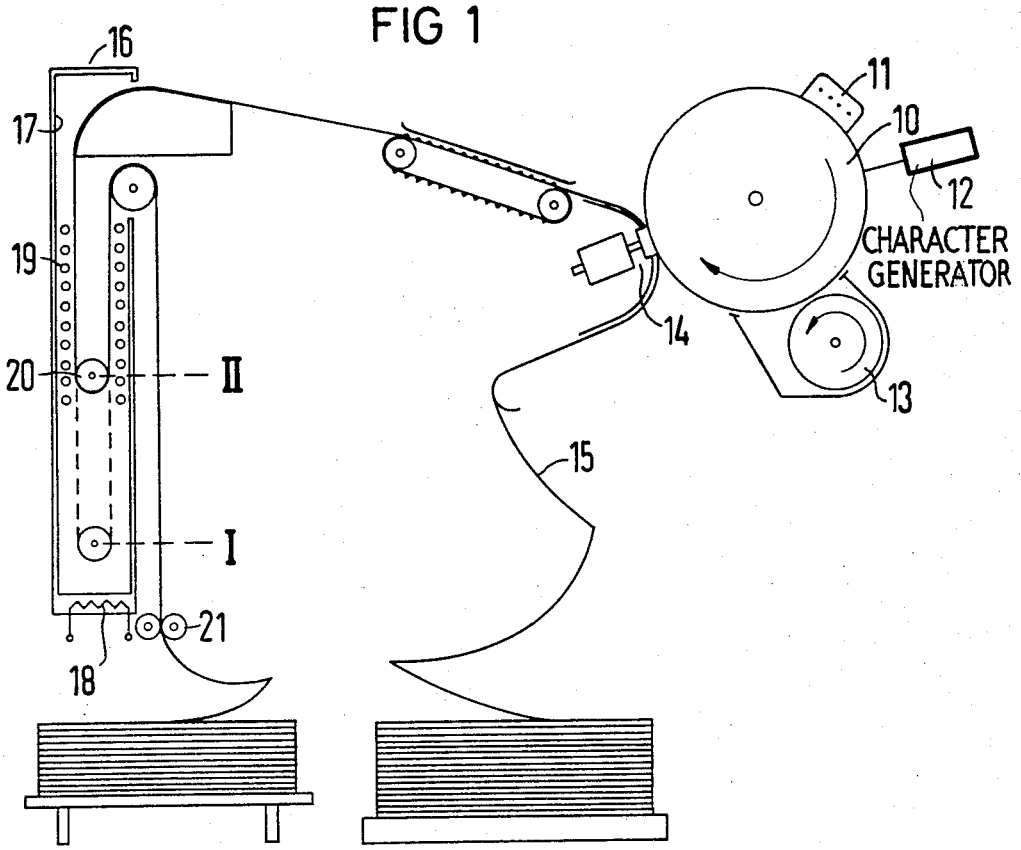
FIG. 1 is a schematic illustration of a laser printer structure as employed in the invention.

The laser printing system described below makes use of a printing method as shown in detail in FIG. 1. A drum 10 having a photo-conductive surface is uniformly charged with the assistance of a corona charging means 11. Charge images are subsequently generated on the drum 10 with the assistance of a character generator 12, for example, a controlled light beam of a laser. The charge images are subsequently developed in a developing station 13, for example according to the magnetic brush principle. The toner images now disposed on the surface of the drum 10 are transferred in a transfer station 14 to image reception material 15, for example a paper web, as the final recording medium.

For this purpose, the image reception material 15 approaches the surface of the drum 10. It is subsequently conducted through a cold fixing station 16. The structure of the station 16 is more extensively described in, for example, German OS No. 28 38 864, corresponding to U.S. Pat. No. 4,264,304, incorporated herein by reference. The fixing station 16 is first composed of a container 17 in whose bottom surface a heating means 18 is disposed. A solvent situated at the floor of the container 17 is evaporated by heating. In order to prevent an emergence of the solvent vapor from the container 17, cooling hoses 19 are disposed in the upper region of the container. Solvent vapor condensed in this region drips back to the floor of the container.

The image reception material 15 is conducted through the container 17 with the assistance of a guide drum 20. When fixing is to be carried out, the guide drum 20 is situated in position I; the image reception material 15 is thus situated in the region of the solvent vapor which can influence the toner image applied thereto. It is preferable to remove the image reception material 15 out of the region of the solvent vapor during operating pauses. For this purpose, the guide drum 20 is moved upward in the container 17 and is brought into the region of the cooling hoses 19, namely into the position II. After the paper web 15 has passed through the fixing station, it is stacked with the assistance of paper transport drums 21 via a corresponding stacking means.

During passage of the paper web 15 through the printing means, a variety of effects which disturb the print image can occur. Thus, for example, toner can remain adhering to the paper transport drums 21 and this can lead to a so-called off-set printing effect, or solvent vapor can be condensed at the guide drums 20 of the fixing station 16, this smearing the toner image on the paper web 15.

Figure 2:
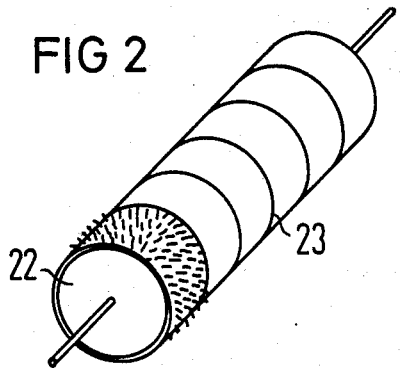
FIG. 2 is a schematic illustration of a paper deflection drum.

In order to avoid these disadvantageous effects, paper deflection drums designed in accordance with FIG. 2 are employed at least in the fixing station. These paper deflection drums are designed with very low inertia, and are composed of a rigid expanded member 22 of polymethacrylimide on which a crepe tape 23 comprising a plurality of individual, thorn-like plastic elements is applied. Deriving as a result of this structure is a low-mass paper deflection drum having low thermal conductivity, so that no solvent vapor can condense on the surface of the fixing drum (guide drum 20). Smeared printing when accelerating or decelerating the paper web 15, and a corresponding off-set printing effect, are thus prevented.

A laser printer constructed in such fashion can now be redesigned for verso printing in accordance with the invention. The fixing station has thus been only schematically indicated for the sake of clarity in the examples to be described below. For the purpose of generating verso printing, a first printer 30 is coupled with a second printer 31 in accordance with the illustration of FIG. 2 in such fashion that the recording medium 15 emerging from the paper exit region 32 is supplied via a coupling means to the paper entry region 29 of the second printer 31. The two printers 30 and 31 are simultaneously operated and are synchronized via a synchronization means to be described later.

In order to guarantee a disruption-free paper transport and in order to keep the space requirements as low as possible, the printers 30 and 31 erected at right angles relative to one another are coupled via a coupling means which is compsoed of a crush-proof tunnel 33 accepting the paper web. In order to be able to access the paper web in case of disruption, and in order, for example, to facilitate threading, the cover 34 of the tunnel 33 is hingeably designed. The tunnel thus serves both as a guide element for the paper web as well as for protection for the paper web between the two printers 30 and 31. The tunnel can be walked on and has an anti-slide mat on its surface.

A deflection means which turns the paper web 15 is situated in the paper entry region 29 of the following, paper-accepting printer 31. The deflection means is composed of a round rod 35 with beveled ends which comprise a latch opening. The latch openings of the round rods 35 thus cooperate with corresponding latch noses 36 (FIG. 6) in the paper entry region 32.

In order to be able to produce both verso printing as well as two-color printing with the printing system, the round rod 35 in the paper entry region 32 is designed to be repluggable. The position shown in FIG. 3 corresponds to the function "verso printing". In the function "verso printing", the round rod 35 is movably guided in rails 37 (FIG. 6) attached in the side walls of the paper entry region 32 in accordance with the illustration of FIG. 6 (illustration of the round rod 35 with solid lines). A position adaptation of the paper web with respect to the edges of the single sheets of the pre-folded continuous form paper, for example, occurs by means of displacement on these rails 37 and locking via a corresponding knurled screw 38. This position adaptation for positioning the individual holders is necessary, particularly given verso printing, as a consequence of turning the paper web over. Given the position shown in FIG. 4 (dot-dash illustration of FIG. 6) for two-color printing, the round rod 35 is rigidly latched in the retaining element 39 via latch noses 36.

After deflection via the round rods 35, in order to be able to subsequently smooth the paper web and supply it in proper attitude to the printing means, and in order to compensate the frictional losses due to the deflection, two paper deflection drums or rods 40 and 41 serving as straight guide elements are disposed above the round rod 35 in the paper entry region 32 of the printer 33. In order to achieve verso printing in accordance with the illustration of FIG. 3, the paper web 15 is directly guided via the paper deflection rod 40 after deflection by the round rod 35. In order to achieve two-color printing wherein turning of the paper web is not provided as in one-sided printing, the paper web 15 is first guided over the paper deflection drum or rod 41 after being deflected by the round rod 35, and is then guided over the paper deflection drum or rod 40. The paper deflection drum 41 is displaceably seated in accordance with the illustration of FIG. 6. The psoition of the paper deflection drum 41 can be adapted to various operating conditions. Thus, the position of the paper deflection drum 41 is different in the mode with the round rod removed, i.e. in a normal one-sided printing mode, than in the one-sided two-color printing mode corresponding to FIG. 4.

As shown in FIG. 6, a paper length compesnation means in the manner of a loop puller is, situated in the tunnel region 33 below the paper entry region 29 of the printer 31 for the purpose of paper length compensation, and in order to facilitate the insertion of the paper web. The paper length compensation means is disposed below the actual frame of the printer 31 in an advantageous, space-saving manner. This paper length compensation means, however, can also be disposed in the paper exit region 32 of the printer 30. It is composed of a stationarily disposed, first deflection roller 42 and of a second deflection roller 46 longitudinally displaceable between an idle position and a paper insertion position via a motor 43 and cable pulls 45. The deflection roller 46 is seated at one side on a guide rod 47; at the other side, it runs directly on the floor, for example, on roller bearings 48. Sensor units 49 and 50 designed as switches are situated in the displacement region of the second deflection roller 46. In accordance with the illustration of FIG. 6, they serve to trigger an alarm unit 51 or serve as generators for an evaluation and control unit 55. When, for example, the paper web is too long between the two printers 30 and 31, the second deflection roller 46 moves to the back stop in the region of the sensor switch 49.

In order to generate a constant paper tension at the paper web, the motor 43 is constantly in non-positive lock with the cable pulls 45 during printer operation with a looped-through paper web, and thus constantly exerts a back-tension force on the paper web in the direction toward the idle position. When the paper web is too short, then the paper web 15 pulls the second deflection roller 46 into the environment of the position of the sensing means 50 and the alarm unit (lamp) is actuated and the first printer 30 is stopped. In order to insert the paper web, the motor 43 and thus a second deflection roller 46 can be directly controlled via the printer controls.

Figure 5:
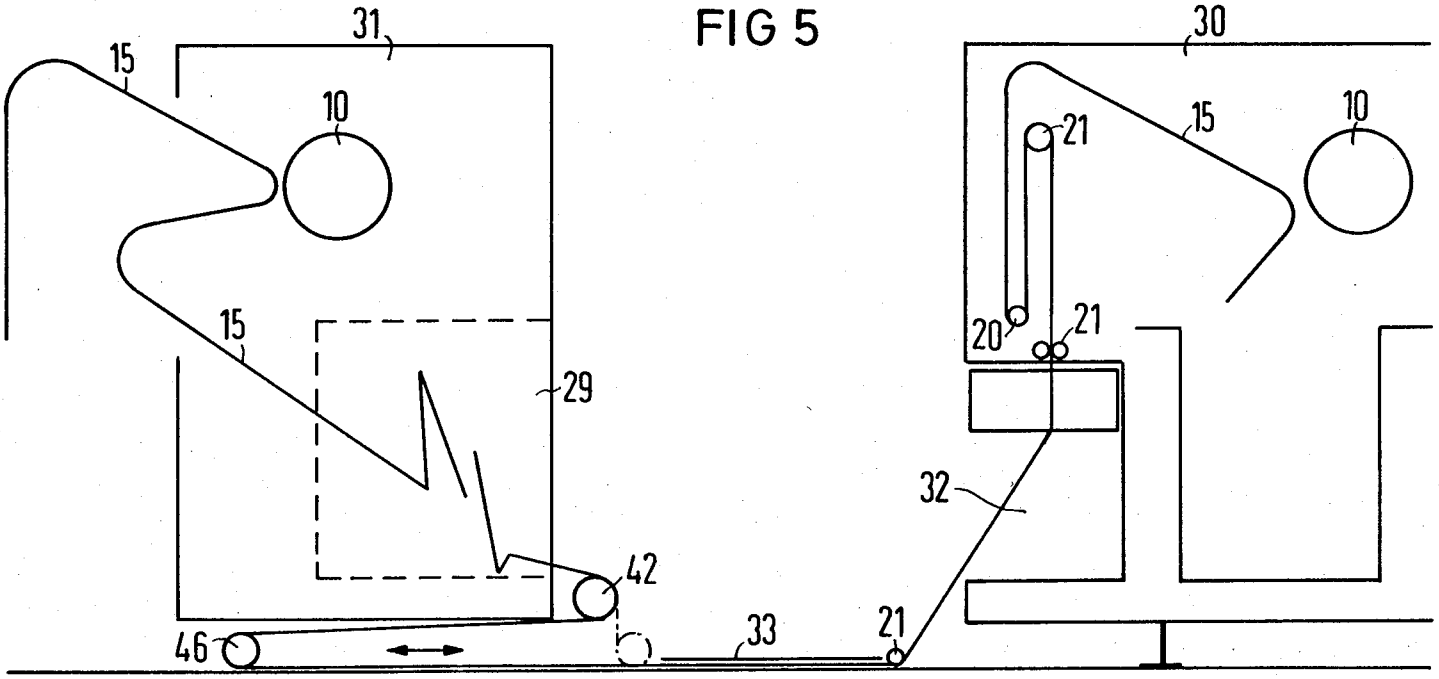
FIG. 5 is a simplified sectional view of the paper web of the laser printing system.

For insertion of the paper, the second deflection roller 46 is moved in accordance with the illustration of FIG. 5 from the back position into the threading position illustrated with broken lines. Although the work rhythm and the timing of such apparatus generally allow a sheet-synchronized mode which would enable a constant paper length between the apparatus, the unavoidable start and stop operations have not as yet been completely synchronized for reasons due to fundamental operating principles. These situations which are unavoidable during the start and stop events are compensated by the described paper length compensation means, whereby the automatic tensioning via the second deflection roller 46 enables optimum handling when inserting the paper web.

Figure 3:
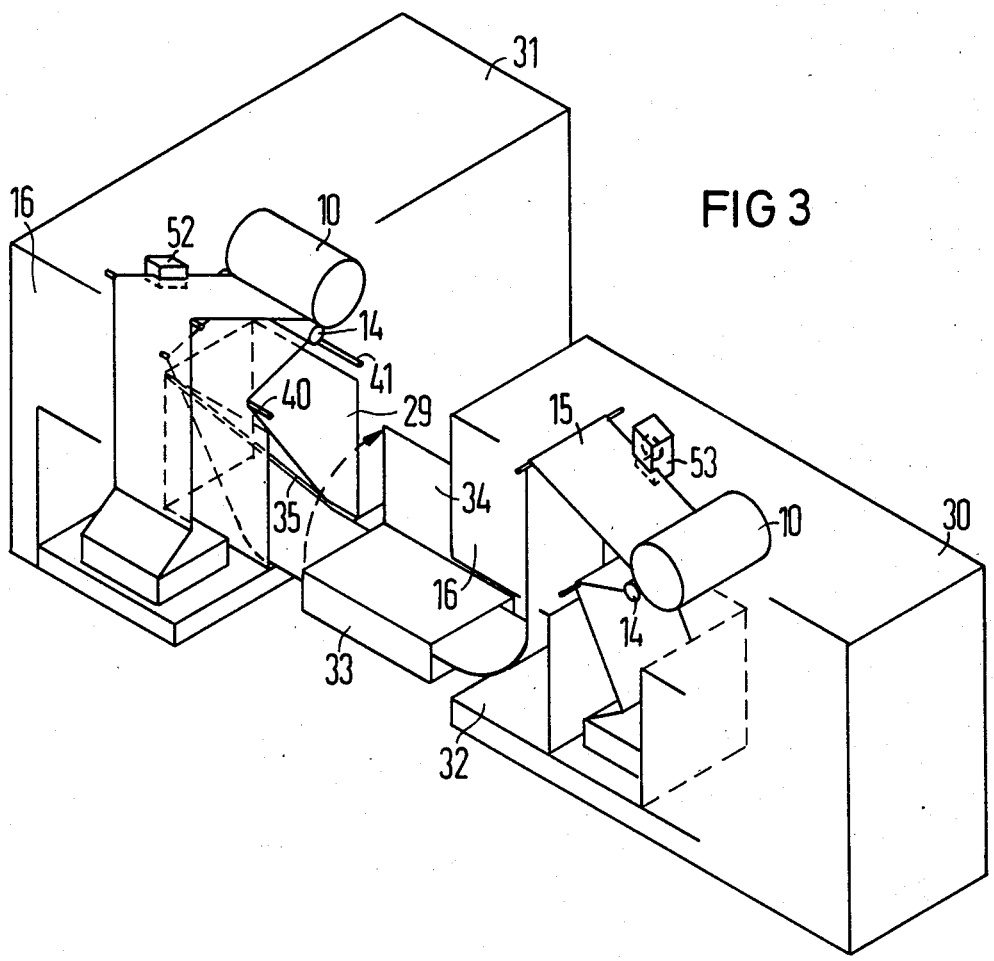
FIG. 3 is a schematic illustration of a laser printing system for verso printing.
Figure 4:
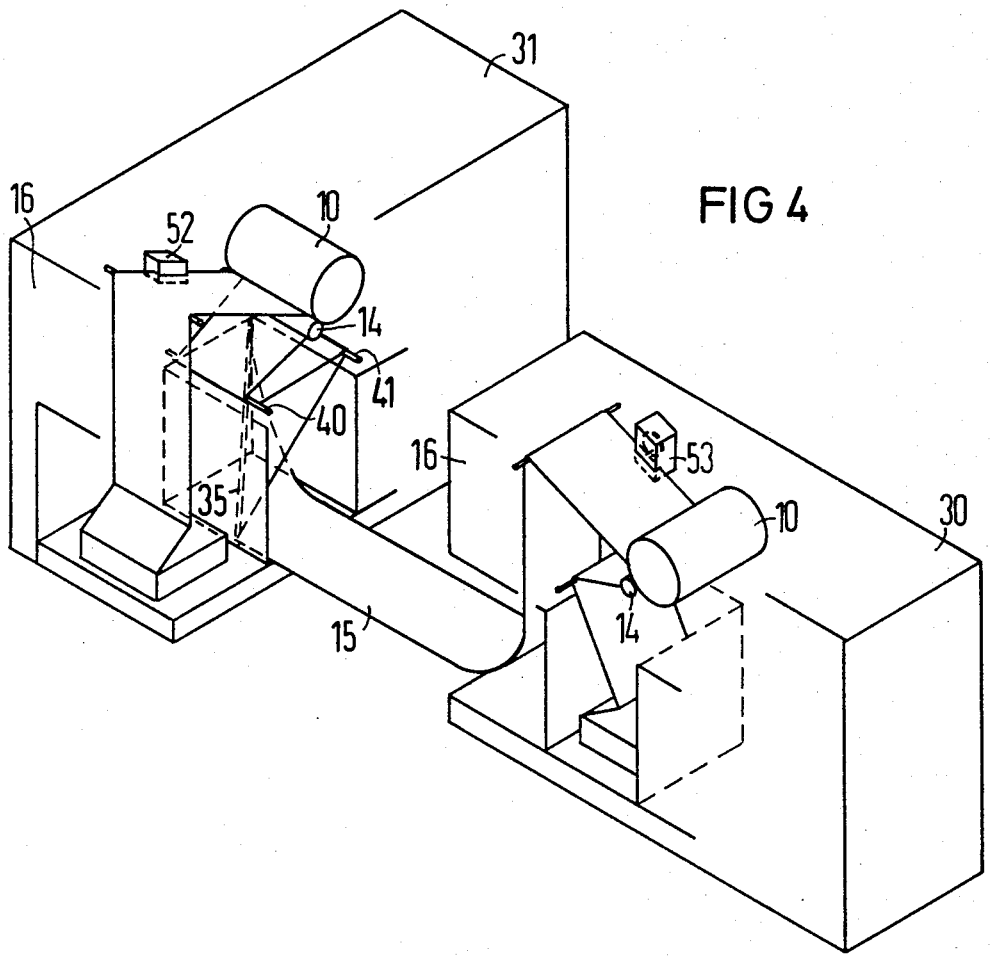
FIG. 4 is a schematic illustration of a laser printing system for one-sided two-color printing.

Sensing units 52 and 53 are situated in the region of the paper feed in accordance with the illustration of FIGS. 3 and 4 for synchronization of the two printers 30 and 31. These sensing units 52 and 53 are composed of standard timing discs engaging into margin perforations of the paper web 15, said timing discs being sensed via corresponding sensing means. They generate a synchronization signal per line—even though the printing occurs page-by-page. The synchronization .signals (composed of discrete pulses) of the sensing units 52 and 53 are forwarded to a bidirectional counting means 54 in accordance with the illustration of FIG. 6. The two in-coming pulse sets are subtracted from one another in this bidirectional counting means so that it can be determined from the differential sum which of the two printers is leading or lagging. A synchronization tolerance range can be defined by prescribing an absolute amount for the counter reading. When this synchronization tolerance range is crossed, one of the two printers 30 or 31 is stopped by a corresponding evaluation unit 55 designed, for example, as a comparison means. It is stopped in accordance with the operational sign of the differential value derived from the pulses from the bidirectional counter 54. The printer accepting the paper web 15 is thus controlled such that via the printer control unit 56, the single sheet currently being printed is still finished. A synchronization is thus achieved at the spaces between sheets.

When, in accordance with FIGS. 8, 9, and 10, the individual printers or copiers are designed in modular fashion, so that the fixing station is accommodated in a separate fixing module 57, the actual printing station containing the transfer station is accommodated in a separate printer module 58, and the modules 57 and 58 are releasably coupled to one another, then a particularly simple structure results both for multi-color printing as well as for verso printing. When two-color printing is desired, for example in accordance with FIG. 9, then the two printer units 58 which are filled with different toner colors are simply coupled to one another and these printer modules 58 are connected to a shared fixing station 57.

When the two printer modules 58 are connected at one side via hinges 59, then, proceeding from the two-color printing in accordance with FIG. 9, a transition can be made to verso printing by simply pivoting apart by 90 degrees in accordance with FIG. 10. A deflection rod 60 is thus fixed as a deflection element. This deflection rod 60 can be secured within the pivot range of the two printers 30 and 31 such that it is automatically brought into the illustrated working position when the printing system is pivoted apart.

Since the toner image is not yet fixed between the printer modules 58 in this case, corresponding techniques (for example design of the elements in accordance with FIG. 2) must be provided at the deflection elements so as to prevent smearing of the toner image.

The evaluation unit 55 in FIG. 7 is comprised of any standard comparator which detects the value (positive or negative) of counter 54. When the result of the counting process shows a positive value, the comparator stops printer 30. In the case of a negative value, the comparator stops printer 31 or vice versa.

Although various minor changes and modifications might be proposed by those skilled in the art, it will be understood that we wish to include within the claims of the patent warranted hereon all such changes and modifications as reasonably come within our contribution to the art.

| LIST OF REFERENCE CHARACTERS |
|---|
| 10 Drum |
| 11 Corona Discharge Means |
| 12 Character generator |
| 13 Developing Station |
| 14 Transverse Station |
| 15 Image Reception Material (paper web) |
| 16 Fixing Station |
| 17 Container |
| 18 Heating Device |
| 19 Cooling Hoses |
| 20 Guide Drum |
| 21 Paper Transport Drum |
| 22 Rigid Foamed Member |
| 23 Crepe Tape |
| 29 Paper Entry Region |
| 30 Printer |
| 31 Printer |
| 32 Paper Exit Region |
| 33 Tunnel |
| 34 Cover |
| 35 Round Rod |
| 36 Latch Noses |
| 37 Rails |
| 38 Knurled Screws |
| 39 Retaining Element |
| 40 Paper Deflection Drum |
| 41 Paper Deflection Drum |
| 42 First Deflection Element (Drum) |
| 43 Motor |
| 45 Cable Pull |
| 46 Second Deflection Element (Drum) |
| 47 Guide Rods |

-continued

| LIST OF REFERENCE CHARACTERS |
|---|
| 48 earing |
| 59 Switch |
| 50 Switch |
| 51 Alarm Device |
| 52 Sensing Element |
| 53 Sensing Element |
| 54 Bidirectional Counting Means |
| 55 Evaluation Means |
| 56 Printer Control Means |
| 57 Fixing Module |
| 58 Printer Module |
| 59 Hinge |
| 60 Deflection Rod |

We claim as our invention:

1. A non-mechanical printer or copier system, comprising:

a first preceding and a second succeeding printer or copier unit;

the first and second units each having a developing station means at which a toner image is developed and applied to a tape-shaped recording medium at a transfer station;

at least one of the first and second units having a solvent vapor fixing station means associated therewith for fixing the image;

the first and second units being connected in series and simultaneously operated and wherein means are provided such that the recording medium emerging from a medium exit region of the preceding first unit is supplied to a medium entry region of the succeeding second unit; and means for selectively changing the system from verso printing to multicolor printing and vice-versa.

2. A system according to claim 1 wherein the first and second units are each formed of a separate printer module which can be coupled to one another, and a separate shared solvent vapor fixing module containing said fixing station means is provided for a plurality of printer modules coupled to one another.

3. A system according to claim 1 wherein said means for selectively changing comprises deflection means which turns the medium over as needed is provided in a paper guidance channel between the first and second units coupled together.

4. A system according to claim 3 wherein the deflection means comprises a rod-shaped oblique deflection element placed at an angle in the medium entry region of the succeeding second unit, said oblique deflection element having cylindrical rod-like straight guidance elements following in a medium transport direction.

5. A system according to claim 4 wherein the oblique deflection element has mounting means associated therewith so that the deflection element is re-pluggable from a position turning the medium over into a position deflecting the medium.

6. A system according to claim 5 wherein the oblique deflection element is disposed in the medium entry region of the succeeding second unit in said mounting means which includes guide rails permitting the deflection element to be longitudinally displaceable.

7. A system according to claim 1 wherein a releasable coupling means for the medium formed as a crushproof tunnel accepting the medium is provided between the first and second units.

8. A system according to claim 7 wherein a top of the tunnel has a walking tread thereof and is hinged.

9. A system according to claim 1 wherein a medium length compensation means comprising a loop puller is provided at one of the paper entry or exit regions of the first or second units, said medium length compensation means comprising a stationarily disposed first deflection element and a second deflection element longitudinally displaceable and motor-driven between an idle position and a medium insertion position.

10. A system according to claim 9 wherein said second deflection element is in communication via traction means with a motor which moves the second deflection element in a direction of said idle position with a prescribed restoring force for generating a medium tension.

11. A system according to claim 9 wherein sensor element means sense a position of the second deflection element and trigger an alarm means, the sensor means being provided so as to define a desired maximum range of displacement of the second deflection element.

12. A system according to claim 9 wherein the medium length compensation means is positioned below a printer section in the unit and adjacent a floor region thereof.

13. A system according to claim 1 wherein synchronizing means for medium feed is provided, said synchronizing means comprising a first sensing means in the preceding unit and second sensing means in the succeeding unit for generating pulses as a function of medium feed and which are coupled to a bidirectional counting means; and an evaluation device means acquiring a counter reading, said evaluation device means stopping at least one of the preceding and succeeding units as a function of the counter reading.

14. A system according to claim 1 wherein the preceding unit and the succeeding unit are positioned at right angles relative to one another.

15. A system according to claim 1 wherein the first unit and second unit are connected via pivoting means and wherein a medium deflection means is provided for turning the medium over and which is insertable at an angle formed by the two units.

16. A system according to claim 1 wherein medium deflection rods are provided in at least one of the first and second units which have a surface composed of a plurality of thorn-like individual elements.

17. A printing system, comprising:

a preceding printer unit and a succeeding printer unit;

the preceding and succeeding units each having a developing station means at which a toner image is developed and applied to a paper tape-like sheet at a transfer station;

at least one of the first and second units having a cold fixing station means associated therewith for fixing the image without direct heating of the sheet;

the first and second units being connected in series and simultaneously operated;

means being provided such that the paper sheet emerging from a paper exit region of the prededing unit is supplied to a paper entry region of the succeeding unit; and deflection means associated with the paper entry region of the succeeding unit for changing a direction of paper travel for either multicolor or verso printing.

18. A system according to claim 17 wherein said deflection means is movable into first or second positions, the first position permitting verso printing by the two units in combination and the second position permitting two-color printing by the two units in combination.

19. A system according to claim 17 wherein the first and second units each have a printing module and the fixing station means comprises a separate module which is attachable to either of the printer modules.

20. A printer system comprising:

first and second printer modules, each module containing a developing station means at which a toner image is developed and applied to a tape-shaped recording medium at a transfer station therein;

a fixing module comprising a solvent vapor fixing station means for fixing the image on the tape-shaped recording medium;

the second module being connected to follow the second module;

the fixing module being connected to follow the second printer module; and means being provided for selectively feeding the tape-shaped recording medium form the first printer module to the second printer module for multicolor printing or for verso printing.

21. A system according to claim 20 wherein the first module and second module are arranged hingeably connected and at an angle to one another and a tape-shaped recording medium deflecting means is present at an angle between the two units so as to deflect a path of travel from the first module to the second module.

* * * * *